US009139269B2

(12) United States Patent
Higgins et al.

(10) Patent No.: US 9,139,269 B2
(45) Date of Patent: Sep. 22, 2015

(54) HULL CLEANER

(76) Inventors: John Andrew Higgins, Hamilton (NZ); Michael Andrew Heap, Auckland (NZ)

( * ) Notice: Subject to any disclaimer, the term of this patent is extended or adjusted under 35 U.S.C. 154(b) by 180 days.

(21) Appl. No.: 13/814,913

(22) PCT Filed: Jul. 25, 2011

(86) PCT No.: PCT/NZ2011/000143

§ 371 (c)(1),
(2), (4) Date: Feb. 7, 2013

(87) PCT Pub. No.: WO2012/021071

PCT Pub. Date: Feb. 16, 2012

(65) Prior Publication Data

US 2013/0133149 A1 May 30, 2013

(30) Foreign Application Priority Data

Aug. 10, 2010 (NZ) ..... 587286

(51) Int. Cl.
*B63B 59/00* (2006.01)
*B63B 59/08* (2006.01)

(52) U.S. Cl.
CPC ..... *B63B 59/08* (2013.01)

(58) Field of Classification Search
USPC ..... 114/222
IPC ..... B63B 2059/082,59/08
See application file for complete search history.

(56) References Cited

U.S. PATENT DOCUMENTS

| | | | | |
|---|---|---|---|---|
| 4,102,290 | A * | 7/1978 | Weiss | 114/222 |
| 4,407,213 | A * | 10/1983 | Evans | 114/222 |
| 5,209,176 | A * | 5/1993 | Pompei et al. | 114/222 |
| 6,263,821 | B1 * | 7/2001 | Hodder | 114/222 |

FOREIGN PATENT DOCUMENTS

| | | |
|---|---|---|
| EP | 0029330 | 5/1981 |
| WO | WO0101818 | 1/2001 |

* cited by examiner

*Primary Examiner* — Stephen Avila
(74) *Attorney, Agent, or Firm* — Weiss & Moy, P.C.; Jeffrey D. Moy

(57) ABSTRACT

A boat hull cleaner comprises a pole having at least two parts 2, 3 which can be set at an angle with respect to one another, a float 6, and a brush 7, the float having a buoyancy portion which gives a minimum buoyancy to the float. The float has an opening or openings arranged to admit water into the float when it is tilted while under water with the result that effective buoyancy of the float is adjusted. The hull cleaner is formed such that when it is in use a human operator can hold one end of the pole from above water level and move it to manipulate the float and the brush beneath water level such that the float encourages the brush against a boat hull to assist the operator to clean the hull.

13 Claims, 5 Drawing Sheets

HULL CLEANER

FIELD OF INVENTION

A preferred form of this invention relates to a hull cleaner for use with water vessels, for example pleasure craft.

BACKGROUND

A problem with yachts, launches and other pleasure craft is that the parts which are submerged beneath the water for long periods of time can become covered in undesirable matter, for example with algae or other marine life. It is accordingly an object of a preferred form of the invention to go at least some way towards dealing with this.

SUMMARY OF INVENTION

According to one aspect of the invention there is provided a boat hull cleaner comprising a pole having at least two parts which can be set at an angle with respect to one another, a float, and a brush, the float having a buoyancy portion which gives a minimum buoyancy to the float; the float having an opening or openings arranged to admit water into the float when it is tilted while under water with the result that effective buoyancy of the float is adjusted; the hull cleaner formed such that when it is in use a human operator can hold one end of the pole from above water level and move it to manipulate the float and the brush beneath water level such that the float encourages the brush against a boat hull to assist the operator to clean the hull.

Preferably the brush has bristles arranged in a curved configuration.

Preferably the curved configuration is generally semi-circular.

Preferably the pole is telescopic.

Preferably the pole is in at least two parts, one either side of a knuckle.

Preferably the knuckle is such that the two parts of the pole can be set to an inclined disposition with respect to one another.

Preferably the knuckle is such that the two parts of the pole can be folded about the knuckle to be parallel with respect to one another.

Preferably when the two parts of the pole are parallel they lay substantially against one another.

Preferably the float is generally curved outwards from the rest of the hull cleaner.

Optionally the buoyancy portion comprises a sealed gas (eg air) chamber which gives minimum buoyancy to the float to enable it to function as set out above.

Optionally the buoyancy portion comprises a solid body which gives minimum buoyancy to the float to enable it to function as set out in claim 1.

GENERAL DESCRIPTION OF THE DRAWINGS

Some preferred embodiments of the invention will now be described by way of example and with reference to the accompanying drawings, of which:

FIG. 1 illustrates a boat hull cleaner in use;

FIG. 2 further illustrates the hull cleaner in use;

DETAILED DESCRIPTION

Figure 1:
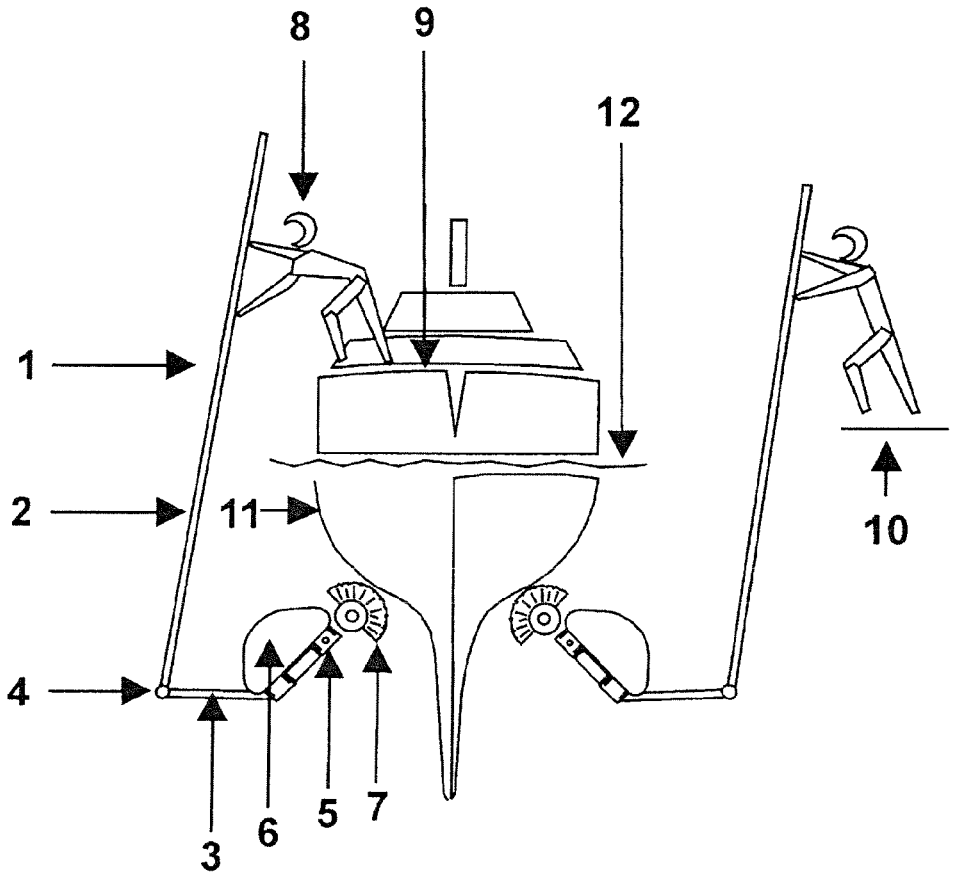

Referring to FIG. 1, the hull cleaner 1 comprises a telescoping pole in two parts 2 and 3 with a knuckle joint 4 therebetween. The joint 4 allows the two parts of the pole 2 and 3 to be set at varying angles with respect to one another, for example at an angle of between 0° and 260°. The smaller part of the pole 3 is connected to a permanently angled support shaft 5, which in turn connects to a float 6 and a scrubbing brush 7. The brush 7 is "half round" in the sense that its bristles have a semi-circular configuration as shown. In other embodiments the brush bristles may have an alternative arc-like configuration.

Figure 2:
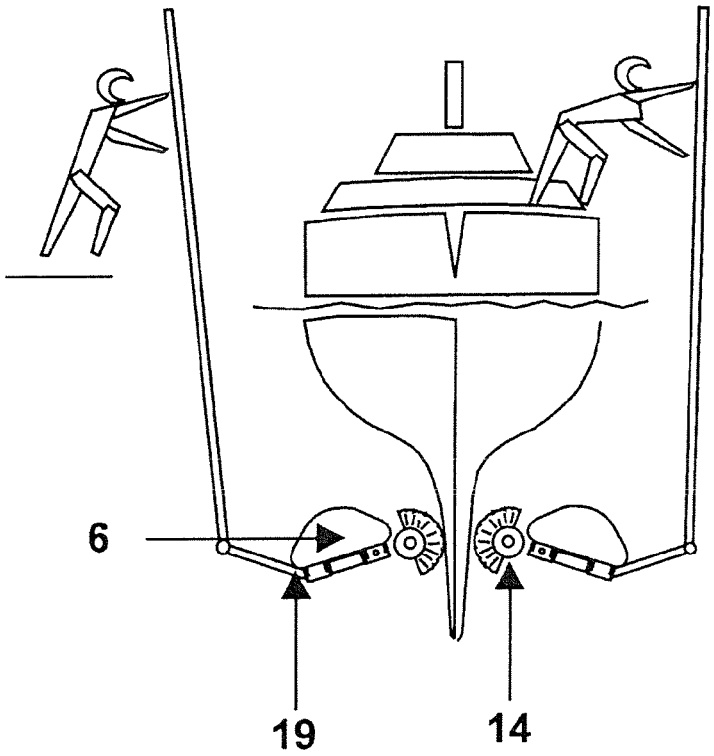

With further reference to FIG. 1, a person 8 can stand on the deck of a boat 9, or on a jetty 10 next to the boat, and manipulate the hull cleaner by hand to scrub the boat's hull 11 beneath the waterline 12. The two parts of the pole 2 and 3 are set at the most desirable angle for achieving this and, as shown, the brush 7 is angled upwards. Referring to FIG. 2, the keel part of the hull can be cleaned by working the brush 7 in the same way but at a greater depth of water.

Figure 3:
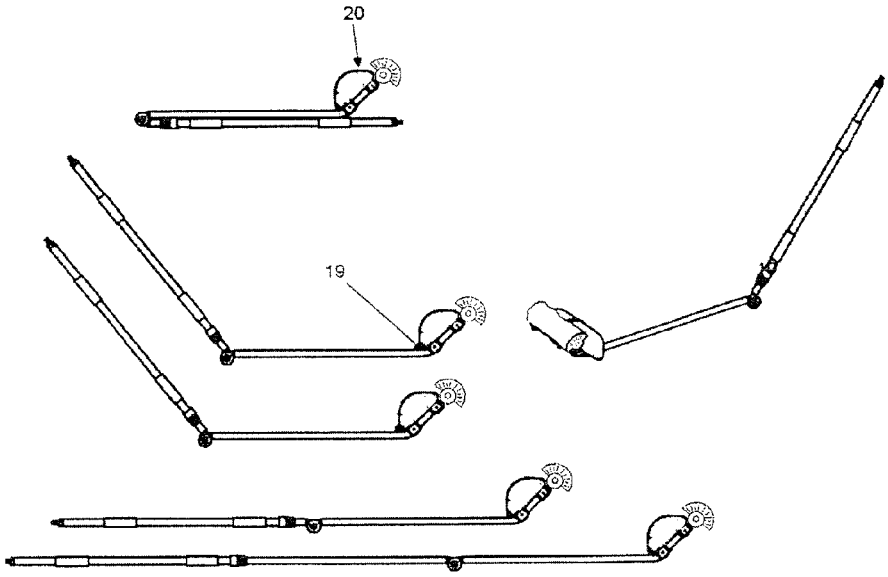
FIG. 3 illustrates the hull cleaner when set at various pole dispositions.

FIG. 3 shows the hull cleaner in more detail, illustrating a number of angles to which the two parts of the pole 2 and 3 can be set.

Figure 4:
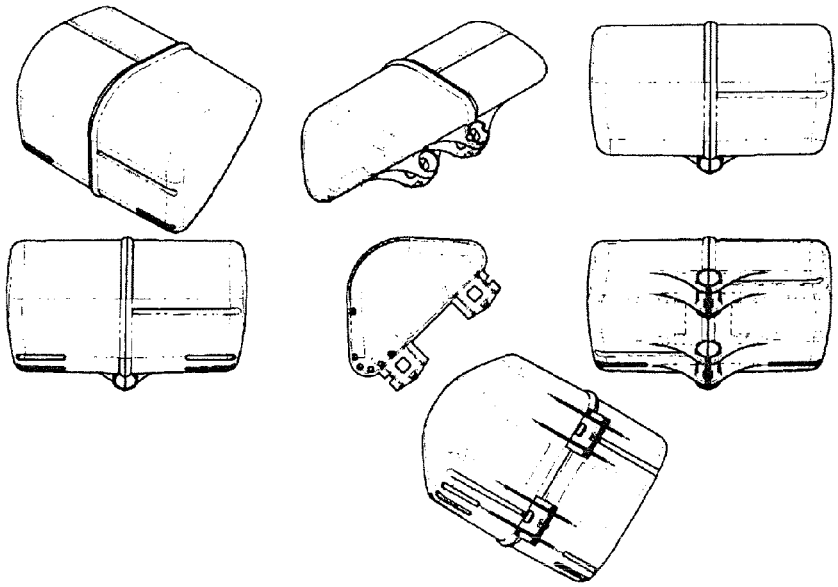
FIG. 4 shows a float forming part of the hull cleaner from various angles.
Figure 5:
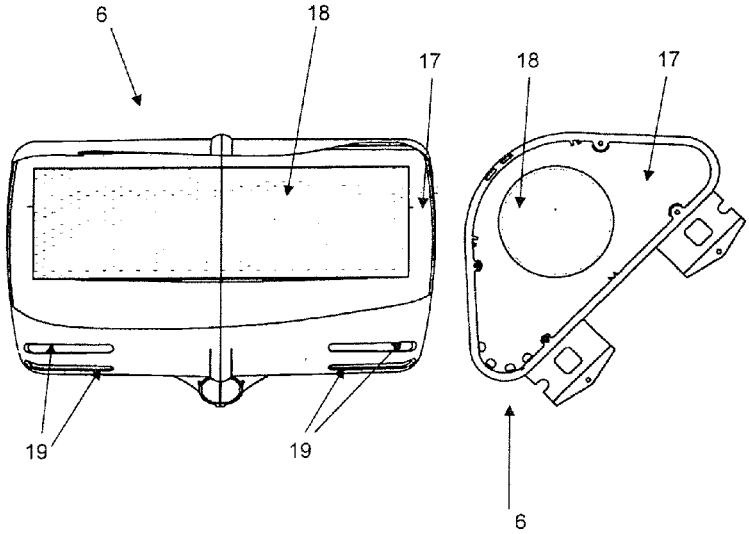
FIG. 5 shows longitudinal and transverse cross section views through the float.
Figure 6:
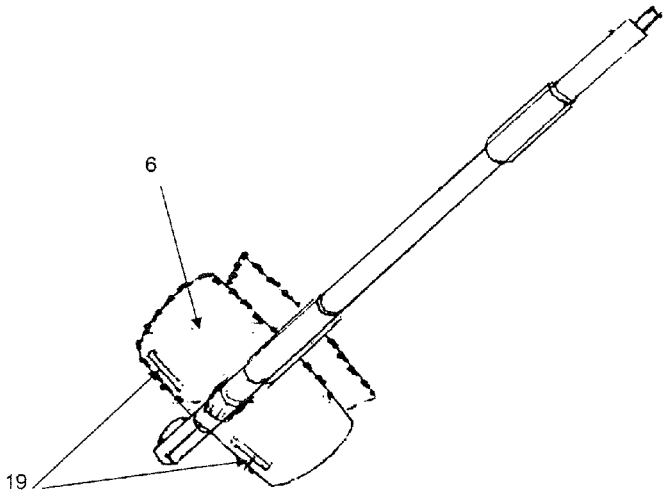
FIG. 6 illustrates tipping of the hull cleaner to allow water into the float.

Referring to FIG. 4, the flotation device 6 is shown separately from the other parts of the hull cleaner and at various angles. The cutaway images of the float 6 at FIG. 5 show that it has a main chamber 17, preferably of about 5-6 L capacity, and generally triangular in transverse cross section. This main chamber envelopes a smaller sealed internal air chamber 18 which is preferably of about 2 L capacity. In alternative embodiments the sealed air chamber 18 may be substituted by a body of material with natural buoyancy, for example by a similarly shaped foam cylinder with approximately the same buoyancy as the sealed air chamber. As shown, the main chamber 17 has one or more permanent openings 19 and these enable it to fill with water if they are caused to face upwards while submerged.

When the hull cleaner is in use as per FIG. 1 the float 6 can be oriented with the openings 19 downwards so as to prevent water from entering the main chamber 17, or to at least only allow a minimal amount of water into that chamber. The buoyancy provided by air within the main and sealed air chambers 17 and 18 means that the brush 7 can be more readily worked against the hull 11 (eg it pushes the brush upwards to make it easier to keep the brush in contact with the hull). However when it is necessary to go deeper, for example to scrub the boat's keel as shown in FIG. 2, or rudder, it is desirable to reduce the buoyancy of the float 6. As will be appreciated, a very buoyant float can be difficult to push down to the correct depth and then manipulate at that depth, or not be able to be pushed down to the required depth at all. The buoyancy of the float 6 can be reduced by filling the main chamber 17 with water before putting the hull cleaner to use. It is also possible to fill the main chamber by submerging and turning the float to an upside down position. This causes the openings 19 to face upwards allowing water to enter the main chamber 17. Either way, because the internal chamber 18 is sealed the float will not loose all of its buoyancy, even if the area in the main chamber surrounding the internal chamber is filled completely. The water in the main chamber 17 can be drained through the openings 19 when the float is withdrawn from the water.

The fact that the brush 7 has bristles in a "half round" configuration means that the bristles are acceptably oriented regardless of whether the brush is being used to clean the hull or the keel of a boat. In some known arrangements involving a brush with bristles in a standard linear arrangement it is necessary to significantly adjust the angle of the brush to ensure that the bristles remain in contact with the surface it is cleaning. The half round brush described above obviates the need for that in at least many hull or keel cleaning situations.

The ability to allow water into the main chamber 17 is beneficial if for example the hull cleaner is used to clean a boat hull, ie as opposed to a keel, and the float goes too far, passing to the other side of the centreline of the boat's hull, and then floating upwards. In this way the hull cleaner could become snagged at the bottom of the hull's centreboard. However in this sort of situation the float 6 can be tilted on its side to allow water into the main chamber 17, thus causing it to sink a little, and from there the hull cleaner can be retrieved from the water.

More specifically, when the main chamber 17 is flooded its buoyancy is reduced, which enables one to more easily free the hull cleaner from a snagged position at the lower centreboard of the hull. For example an operator can more easily push downwards on the pole and retrieve the float 6 and brush 7 by then pulling back on the handle so that they move away from the centreboard of the hull.

In some embodiments of the invention the upper curvature 20 of the float 6 (see FIGS. 1, 2 and 3) minimises the risk of snagging but the ability to sink it deeper into the water can still be of assistance in certain circumstances. The float is shaped such that as it passes the centreboard of a hull the operator 8 feels a 'thump' caused by contact between the upper curvature 20 and the hull's centreboard. The float thus acts as an "over rider". This alerts the operator that the brush 7 and float have gone over centre and that he or she should pull back on it to prevent snagging. If the hull cleaner becomes snagged then in some instances an operator working from the deck of a boat may slide the float longitudinally along the submerged centreboard of the boat to the front of the bow to un-snag the hull cleaner.

In some embodiments of the invention the knuckle 4 may incorporate a spring tensioned ratchet hinge mechanism and is designed so that the two lengths of pole 2 and 3 can be set to an 'in-line' disposition. To adjust the angle of the two lengths of pole 2, 3 with respect to one another a knuckle bolt is unscrewed a little and opposing sides of the knuckle caused to rotate so that teeth of each half ride over one another in an up and down action due to spring pressure.

While some preferred forms of the invention have been described by way of example it should be appreciated that modifications and improvements can occur without departing from the scope of the following claims.

The invention claimed is:

1. A boat hull cleaner comprising a pole having at least two parts which can be set at an angle with respect to one another, a float, and a brush, the float having a buoyancy portion which give a minimum buoyancy to the float;

the float having an opening or openings arranged to admit water into the float when it is tilted while under water with the result that effective buoyancy of the float is adjusted;

the hull cleaner formed such that when it is in use a human operator can hold one end of the pole from above water level and move it to manipulate the float and the brush beneath water level such that the float encourages the brush against a boat hull to assist the operator to clean the hull.

2. A boat hull cleaner according to claim 1 wherein the brush has bristles arranged in a curved configuration.

3. A boat hull cleaner according to claim 1 wherein the brush has bristles arranged in a generally semi-circular configuration.

4. A boat hull cleaner according to claim 1 wherein the pole is telescopic and the brush has bristles arranged in a curved configuration.

5. A boat hull cleaner according to claim 1 wherein the pole is in at least two parts, each either side of a knuckle.

6. A boat hull cleaner according to claim 5, wherein the knuckle is formed such that the two parts of the pole can be set to an inline disposition with respect to one another.

7. A boat hull cleaner according to claim 5 or 6 wherein the knuckle is formed such that the two parts of the pole can be folded about the knuckle to be parallel with respect to one another.

8. A boat hull cleaner according to claim 7, wherein when the two parts of the pole are parallel they lay substantially against one another.

9. A boat hull cleaner according to claim 1, wherein the float is generally curved outwards from the rest of the hull cleaner.

10. A boat hull cleaner according to claim 1, wherein the buoyancy portion comprises a sealed gas chamber which give minimum buoyancy to the float to enable it to function as set out in claim 1.

11. A boat hull cleaner according to claim 1, wherein the buoyancy portion comprises a solid body which give minimum buoyancy to the float to enable it to function as set out in claim 1.

12. A boat hull cleaner comprising a telescopic pole having at least two parts, each part being either side of a knuckle so that the two parts of the pole can be set at an incline with respect to one another and can be subsequently folded about the knuckle to be parallel with respect to one another, a float which is generally curved outwards of the rest of the hull cleaner, and a brush, the float having a buoyancy portion, comprising one of a sealed gas chamber and a solid body, which gives a minimum buoyancy to the float;

the float having an opening or openings able to admit water into the flat when it is tilted if under water to cause effective buoyancy of the float to be adjusted;

the hull cleaner formed such that it is able to be held at one end of the pole above water level and moved to manipulate the flat and the brush beneath water level such that the float encourages the brush against a boat hull to assist a human operator to clear the hull.

13. A boat hull cleaner according to claim 12 wherein the brush has bristles arranged in a curved configuration.

* * * * *